US007844452B2

(12) United States Patent
Takeuchi et al.

(10) Patent No.: US 7,844,452 B2
(45) Date of Patent: Nov. 30, 2010

(54) SOUND QUALITY CONTROL APPARATUS, SOUND QUALITY CONTROL METHOD, AND SOUND QUALITY CONTROL PROGRAM

(75) Inventors: Hirokazu Takeuchi, Machida (JP); Hiroshi Yonekubo, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/392,921

(22) Filed: Feb. 25, 2009

(65) Prior Publication Data

US 2009/0296961 A1 Dec. 3, 2009

(30) Foreign Application Priority Data

May 30, 2008 (JP) ..... 2008-143021

(51) Int. Cl.
*G10L 21/02* (2006.01)

(52) U.S. Cl. ..... 704/226; 704/217

(58) Field of Classification Search ..... 704/205–228
See application file for complete search history.

(56) References Cited

U.S. PATENT DOCUMENTS

| | | | | |
|---|---|---|---|---|
| 5,280,562 | A | 1/1994 | Bahl et al. | |
| 5,298,674 | A * | 3/1994 | Yun | 84/616 |
| 5,712,953 | A * | 1/1998 | Langs | 704/214 |
| 6,490,554 | B2 | 12/2002 | Endo et al. | |
| 6,570,991 | B1 | 5/2003 | Scheirer et al. | |
| 6,990,453 | B2 | 1/2006 | Wang et al. | |
| 7,130,795 | B2 | 10/2006 | Gao | |
| 7,191,128 | B2 | 3/2007 | Sall et al. | |
| 7,606,704 | B2 * | 10/2009 | Gray et al. | 704/226 |
| 2002/0191798 | A1 * | 12/2002 | Juric et al. | 381/56 |
| 2003/0055636 | A1 * | 3/2003 | Katuo et al. | 704/225 |
| 2009/0296961 | A1 | 12/2009 | Takeuchi et al. | |
| 2009/0299750 | A1 | 12/2009 | Yonekubo et al. | |

FOREIGN PATENT DOCUMENTS

| | | |
|---|---|---|
| JP | 5-232999 | 9/1993 |
| JP | 07-013586 | 1/1995 |
| JP | 08-185196 | 7/1996 |
| JP | 09-160585 | 6/1997 |
| JP | 10-256857 | 9/1998 |
| JP | 2001-265367 | 9/2001 |

(Continued)

OTHER PUBLICATIONS

Scheirer, et al., "Construction and Evaluation of a Robust Multifeature Speech/Music Discriminator",0-8186-7919-0/97 IEEE, 1997, pp. 1331-1334.

(Continued)

*Primary Examiner*—Abul Azad
(74) *Attorney, Agent, or Firm*—Blakely, Sokoloff, Taylor & Zafman LLP

(57) ABSTRACT

According to one embodiment, sound quality control processing for speech or music is performed by calculating various kinds of characteristic parameters to determine a speech signal and a music signal from an input audio signal and determining the input audio signal closer to the speech signal or music signal based on a score difference between a sum of scores provided to characteristic parameters indicating the speech signal and that of scores provided to characteristic parameters indicating the music signal.

8 Claims, 9 Drawing Sheets

FOREIGN PATENT DOCUMENTS

| | | |
|---|---|---|
| JP | 2004-125944 | 4/2004 |
| JP | 2005-266098 | 9/2005 |
| JP | 2006-243676 | 9/2006 |
| JP | 2007-004000 | 1/2007 |
| JP | 2007-017620 | 1/2007 |

OTHER PUBLICATIONS

Carey, et al., "A comparison of Features for Speech, Music Discrimination", 0-7803-5041-3/99, 1999, IEEE, pp. 149-152.

* cited by examiner

SOUND QUALITY CONTROL APPARATUS, SOUND QUALITY CONTROL METHOD, AND SOUND QUALITY CONTROL PROGRAM

CROSS-REFERENCE TO RELATED APPLICATIONS

This application is based upon and claims the benefit of priority from Japanese Patent Application No. 2008-143021, filed May 30, 2008, the entire contents of which are incorporated herein by reference.

BACKGROUND

1. Field

One embodiment of the invention relates to a sound quality control apparatus, a sound quality control method, and a sound quality control program for adaptively performing sound quality control processing on each of a speech signal and a music signal contained in an audio (audible frequency) signal to be reproduced.

2. Description of the Related Art

As is well known, for example, a broadcasting receiving apparatus for receiving TV broadcasting and an information reproducing apparatus for reproducing recorded information from an information recording medium perform sound quality control processing on an audio signal to further improve sound quality when the audio signal is reproduced from a received broadcast signal or a signal read from the information recording medium.

In this case, content of the sound quality control processing performed on an audio signal depends on whether the audio signal is a speech signal such as a talking voice of a person or a music (non-voice) signal such as a musical piece. That is, for a speech signal, sound quality is improved by performing sound quality control processing so as to emphasize center-localized components for articulation like talk scenes and sport live broadcasting and, for a music signal, sound quality is improved by performing sound quality control processing with a sense of spread and an emphasized sense of stereo.

Thus, determining whether a received audio signal is a speech signal or a music signal and then performing corresponding sound quality control processing in accordance with a determination result thereof can be considered. However, a speech signal and a music signal are frequently mixed in an actual audio signal and thus, determination processing is often difficult and so, it cannot be currently said that suitable sound quality control processing is performed on an audio signal.

Jpn. Pat. Appln. KOKAI Publication No. 7-13586 discloses a configuration in which an acoustic signal is classified into three types of "speech", "non-speech", and "undefined" by analyzing the zero-crossing count, power fluctuations and the like of the input acoustic signal, and frequency characteristics with respect to the acoustic signal are controlled to emphasize the voice frequency band when the acoustic signal is determined as "speech", frequency characteristics are controlled to be flat when determined as "non-speech", and frequency characteristics are controlled to maintain characteristics of the previous determination when determined as "undefined".

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, sound quality control processing for speech or music is performed by calculating various kinds of characteristic parameters to determine a speech signal and a music signal from an input audio signal and determining the input audio signal closer to the speech signal or music signal based on a score difference between a sum of scores provided to characteristic parameters indicating the speech signal and that of scores provided to characteristic parameters indicating the music signal.

Figure 1:
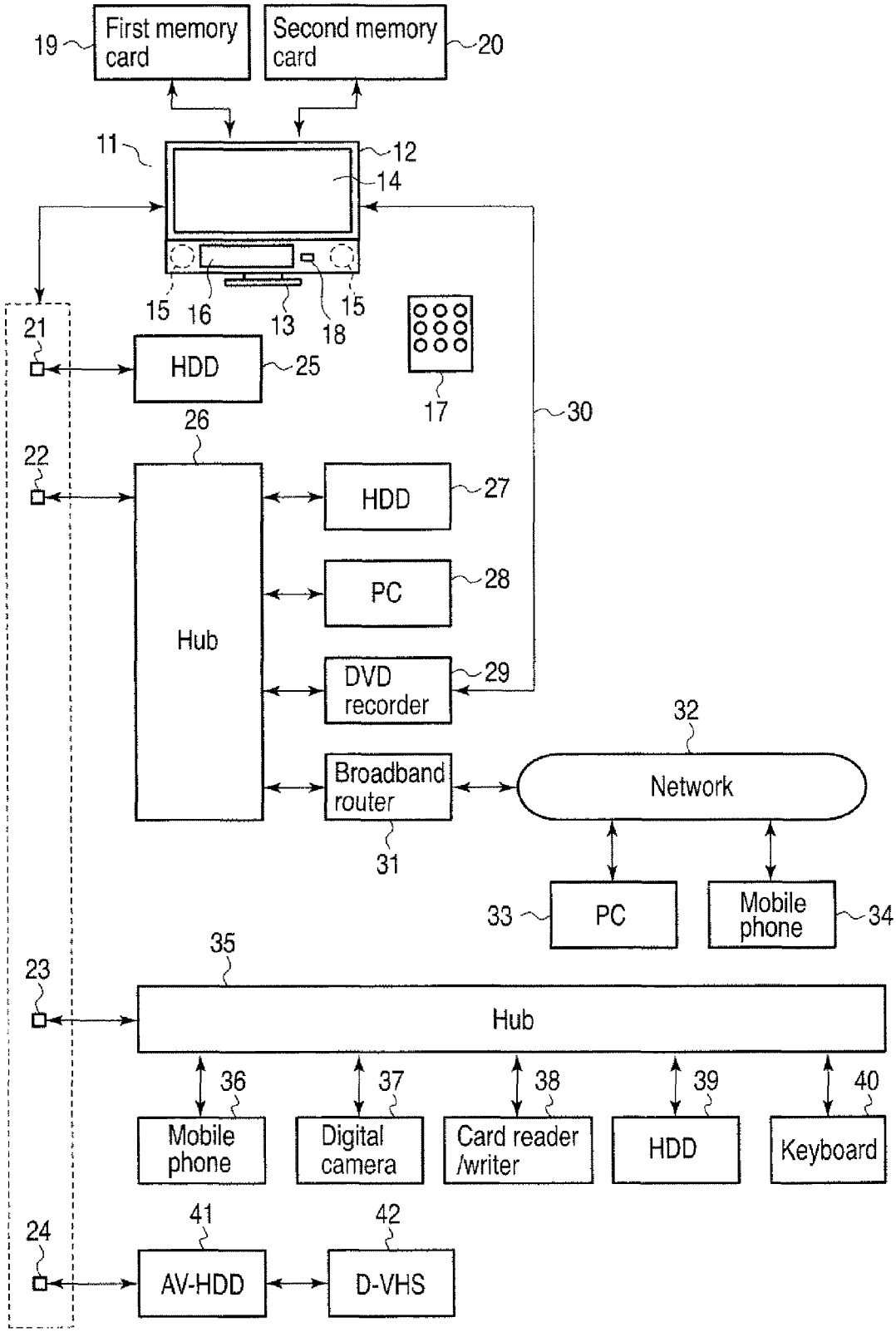
FIG. 1 is a diagram showing an embodiment of the present invention to schematically illustrate a digital TV broadcasting receiving apparatus and an example of a network system centering around the digital TV broadcasting receiving apparatus.

FIG. 1 schematically shows an appearance of a digital TV broadcasting receiving apparatus 11 described in the present embodiment and an example of a network system configured centering around the digital TV broadcasting receiving apparatus 11.

That is, the digital TV broadcasting receiving apparatus 11 consists mainly of a slim cabinet 12 and a support stand 13 to support the cabinet 12 erectly. The cabinet 12 has a flat panel display unit 14 constructed, for example, from an SED (surface-conduction electron-emitter display) display panel or liquid crystal display panel, a pair of speakers 15, 15, an operation module 16, a light receiving module 18 for receiving operation information transmitted from a remote controller 17 formed therein.

Moreover, a first memory card 19 such as an SD (secure digital) memory card, MMC (multimedia card), and memory stick is removable from the digital TV broadcasting receiving apparatus 11, and information such as programs and photos is recorded in/reproduced from the first memory card 19.

Further, a second memory card 20 [such as an IC (integrated circuit) card] in which, for example, contract information is recorded is removable from the digital TV broadcasting receiving apparatus 11 and information is recorded in/reproduced from the second memory card 20.

The digital TV broadcasting receiving apparatus 11 also has a first LAN (local area network) terminal, a second LAN terminal 22, a USB (universal serial bus) terminal 23, and an IEEE (institute of electrical and electronics engineers) 1394 terminal 24.

Among these terminals, the first LAN terminal 21 is used as a dedicated port for LAN compliant HDD (hard disk drive). That is, the first LAN terminal 21 is used to record information in a LAN compliant HDD 25 connected thereto, which is an NAS (network attached storage), or to reproduce information from the LAN compliant HDD 25 via an Ethernet (registered trademark).

By providing the first LAN terminal 21 as a dedicated port for LAN compliant HDD to the digital TV broadcasting receiving apparatus 11, as described above, information of broadcasting programs in HDTV quality can be recorded in the HDD 25 stably without being affected by other network environments or network utilization conditions.

The second LAN terminal 22 is used as a general LAN compliant port using the Ethernet (registered trademark). That is, the second LAN terminal 22 is used to connect devices such as a LAN compliant HDD 27, a PC (personal computer) 28, and a DVD (digital versatile disk) recorder 29 containing an HDD via a hub 26 to construct, for example, a home network for transmission of information to these devices.

In this case, the PC 28 and the DVD recorder 29 have each a function to operate as a server device of the content in a home network and are further configured as a UPnP (universal plug and play) compliant device having a service to provide URI (uniform resource identifier) information necessary for content access.

Since digital information communicated via the second LAN terminal 22 is only control information for the DVD recorder 29, a dedicated analog transmission path 30 is provided to transmit analog video and audio information to the digital TV broadcasting receiving apparatus 11.

Further, the second LAN terminal 22 is connected, for example, to an external network 32 such as the Internet via a broadband router 31 connected to the hub 26. Moreover, the second LAN terminal 22 is used to transmit information to a PC 33, a mobile phone 34 and the like via the network 32.

The USB terminal 23 is used as a general USB compliant port and is used, for example, to connect to a USB device such as a mobile phone 36, a digital camera 37, a card reader/writer 38 for a memory card, an HDD 39, and a keyboard 40 via a hub 35 for transmission of information to these USB devices.

Further, the IEEE 1394 terminal 24 is used to serially connect a plurality of information recording/reproducing devices such as an AV-HDD 41 and a D (digital)-VHS (video home system) 42 for selective transmission of information to each of the devices.

Figure 2:
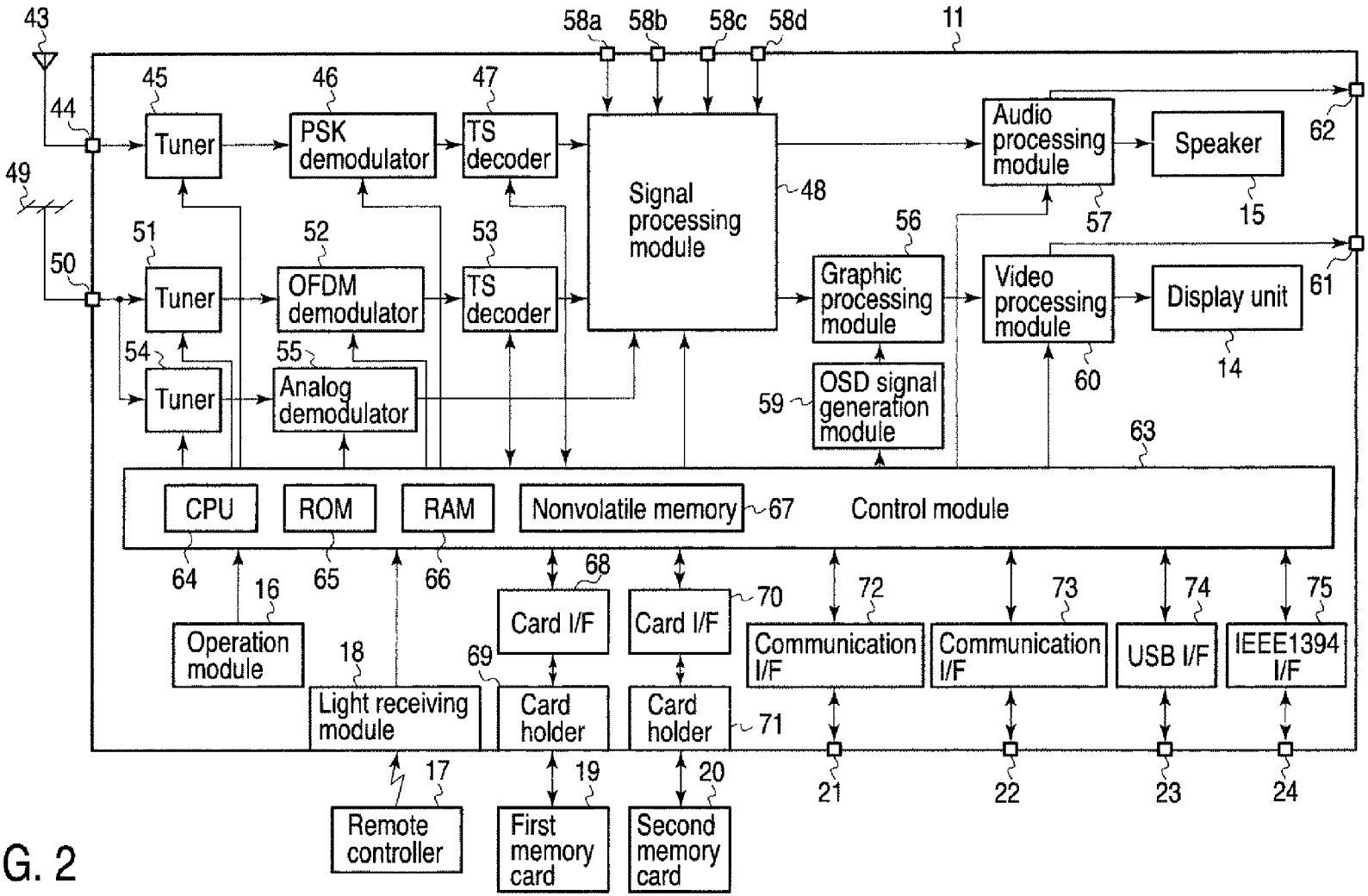
FIG. 2 is a block diagram shown to illustrate main signal processing systems of the digital TV broadcasting receiving apparatus in the embodiment.

FIG. 2 shows main signal processing systems of the digital TV broadcasting receiving apparatus 11 described above. That is, a broadcasting signal of a desired channel is tuned in by a satellite digital TV broadcasting signal received by an antenna 43 for receiving BS/CS (broadcasting satellite/communication satellite) digital broadcasting being supplied to a tuner 45 for satellite digital broadcasting via an input terminal 44.

Then, the broadcasting signal tuned in by the tuner 45 is demodulated to a digital video signal and audio signal by being supplied to a PSK (phase shift keying) demodulator 46 and a TS (transport stream) decoder 47 in turn before being output to a signal processing module 48.

Also, a broadcasting signal of a desired channel is tuned in by a terrestrial digital TV broadcasting signal received by an antenna 49 for receiving terrestrial broadcasting being supplied to a tuner 51 for terrestrial digital broadcasting via an input terminal 50.

Then, the broadcasting signal tuned in by the tuner 51 is demodulated to a digital video signal and audio signal by being supplied, for example, in Japan, to an OFDM (orthogonal frequency division multiplexing) demodulator 52 and a TS decoder 53 in turn before being output to the signal processing module 48.

Also, a broadcasting signal of a desired channel is tuned in by a terrestrial analog TV broadcasting signal received by the antenna 49 for receiving terrestrial broadcasting being supplied to a tuner 54 for terrestrial analog broadcasting via the input terminal 50. Then, the broadcasting signal tuned in by the tuner 54 is demodulated to an analog video signal and audio signal by being supplied to an analog demodulator 55 before being output to the signal processing module 48.

Here, the signal processing module 48 selectively performs predetermined digital signal processing on a digital video signal and audio signal supplied from the TS decoder 47 and 53 before outputting these signals to a graphic processing module 56 and an audio processing module 57 respectively.

A plurality of input terminals (four terminals in FIG. 2) 58*a*, 58*b*, 58*c*, and 58*d* is connected to the signal processing module 48. Each of these input terminals 58*a* to 58*d* enables input of an analog video signal and audio signal from outside the digital TV broadcasting receiving apparatus 11.

The signal processing module 48 selectively digitizes an analog video signal and audio signal supplied from the analog demodulator 55 and each of the input terminals 58*a* to 58*d* and performs predetermined digital signal processing on the digitized video signal and audio signal before outputting these signals to the graphic processing module 56 and the audio processing module 57 respectively.

The graphic processing module 56 has a function to superimpose an OSD signal generated by an OSD (on screen display) signal generation module 59 on a digital video signal supplied from the signal processing module 48 before outputting the superimposed signal. The graphic processing module 56 can output an output video signal of the signal processing module 48 and an output OSD signal of the OSD signal generation module 59 selectively or by combining both output signals to constitute half the screen for each.

A digital video signal output from the graphic processing module 56 is supplied to a video processing module 60. The video processing module 60 converts the input digital video signal into an analog video signal in a format displayable in the display unit 14 and then outputs the analog video signal to the display unit 14 to cause the display unit 14 to display the video and also to lead the video signal to the outside via an output terminal 61.

The audio processing module 57 performs sound quality control processing described later on the input digital audio signal and then converts the digital audio signal into an analog audio signal in a format reproducible by the speakers 15. Then, the analog audio signal is output to the speakers 15 for audio reproduction and also is lead to the outside via output terminal 62.

Here, the digital TV broadcasting receiving apparatus 11 is controlled in a unified manner by a control module 63 in all operations thereof including various receiving operation described above. The control module 63 contains a CPU (central processing unit) 64 and controls each module so that, after receiving operation information from the operation module 16 or that sent from the remote controller 17 and received by the light receiving module 18, operation content thereof is reflected.

In this case, the control module 63 mainly uses a ROM (read only memory) 65 in which a control program executed by the CPU 64 is stored, a RAM (random access memory) 66 providing a work area to the CPU 64, and a nonvolatile memory 67 in which various kinds of setting information and control information are stored.

The control module 63 is also connected to a card holder 69 into which the first memory card 19 can be inserted via a card I/F (interface) 68. Accordingly, the control module 63 can transmit information to the first memory card 19 inserted in the card holder 69 via the card I/F 68.

Further, the control module 63 is connected to a card holder 71 into which the second memory card 20 can be inserted via a card I/F 70. Accordingly, the control module 63 can transmit information to the second memory card 20 inserted in the card holder 71 via the card I/F 70.

The control module 63 is also connected to the first LAN terminal 21 via a communication I/F 72. Accordingly, the control module 63 can transmit information to the LAN compliant HDD 25 connected to the first LAN terminal 21 via the communication I/F 72. In this case, the control module 63 has a DHCP (dynamic host configuration protocol) server function and assigns an IP (internet protocol) address to the LAN compliant HDD 25 connected to the first LAN terminal 21 for control.

Further, the control module 63 is connected to the second LAN terminal 22 via a communication I/F 73. Accordingly, the control module 63 can transmit information to each device (See FIG. 1) connected to the second LAN terminal 22 via the communication I/F 73.

The control module 63 is also connected to the USE terminal 23 via a USE I/F 74. Accordingly, the control module 63 can transmit information to each device (See FIG. 1) connected to the USB terminal 23 via the USE I/F 74.

Further, the control module 63 is connected to the IEEE 1394 terminal 24 via an IEEE 1394 I/F 75. Accordingly, the control module 63 can transmit information to each device (See FIG. 1) connected to the IEEE 1394 terminal 24 via the IEEE 1394 I/F 75.

Figure 3:
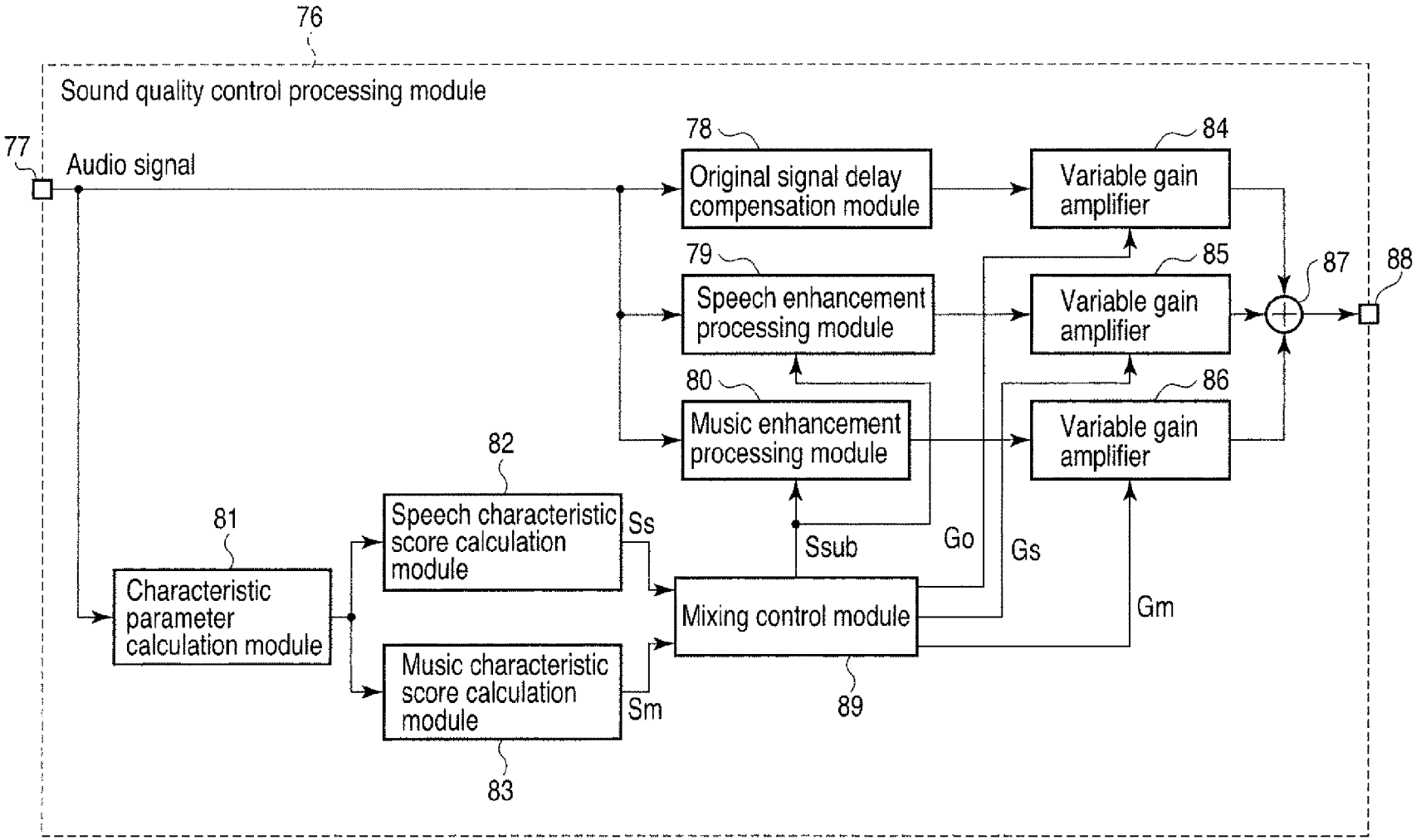
FIG. 3 is a block diagram shown to illustrate a sound quality control processing module contained in an audio processing module of the digital TV broadcasting receiving apparatus in the embodiment.

FIG. 3 shows a sound quality control processing module 76 provided inside the audio processing module 57. In the sound quality control processing module 7C, an audio signal supplied to an input terminal 77 is supplied to each of an original signal delay compensation module 78, a speech enhancement processing module 79, and a music enhancement processing module 80 and also to a characteristic parameter calculation module 81.

Among these components, the characteristic parameter calculation module 81 cuts out the input audio signal in frames of about several hundreds of msec and further divides each frame into sub-frames of several tens of msec. Then, the characteristic parameter calculation module 81 determines the power value, zero-crossing frequency, spectrum fluctuations in the frequency domain, and, for the case of stereo, power ratio (LR power ratio) of left and right (LR) signals in sub-frames and then calculates statistics (such as the average value, variance, maximum value, minimum value and so on) in frames for each to obtain characteristic parameters.

Each characteristic parameter calculated by the characteristic parameter calculation module 81 is supplied to each of a speech characteristic score calculation module 82 and a music characteristic score calculation module 83. In the speech characteristic score calculation module 82 of these modules, a score (speech characteristic score) Ss quantitatively showing whether the audio signal supplied to the input terminal 77 is closer to characteristics of a speech signal based on each characteristic parameter determined by the characteristic parameter calculation module 81 is calculated.

In the music characteristic score calculation module 83, a score (music characteristic score) Sm quantitatively showing whether the audio signal supplied to the input terminal 77 is closer to characteristics of a music (musical piece) signal based on each characteristic parameter determined by the characteristic parameter calculation module 81 is calculated. Details of the speech characteristic score calculation module 82 and the music characteristic score calculation module 83 will be described later.

The speech enhancement processing module 79, on the other hand, performs sound quality control processing so that a speech signal in an input audio signal is emphasized and, for example, a speech signal in live broadcasting of a sports program or a talk scene in a music program is emphasized for articulation. Most of such speech signals are localized, in the case of stereo, in the center and thus, sound quality controls for a speech signal can be made by emphasizing center signal components.

The music enhancement processing module 80 performs sound quality control processing on a music signal in an input audio signal and realizes a sound field with a sense of spreading by performing, for example, wide-stereo processing and reverberation processing on a music signal in a musical piece performing scene in a music program.

Further, the original signal delay compensation module 78 is provided to absorb a processing delay between an original signal as an input audio signal unchanged and a speech signal and a music signal obtained from the speech enhancement processing module 79 and the music enhancement processing module 80 respectively. Accordingly, generation of an unusual sound due to a time lag of each signal when an original signal, speech signal, and music signal are mixed (or switched) in a subsequent stage can be prevented.

Then, an original signal, speech signal, and music signal output from the original signal delay compensation module 78, the speech enhancement processing module 79, and the music enhancement processing module 80 are supplied to variable gain amplifiers 84, 85, and 86 respectively to be amplified by a predetermined gain before being mixed by an adder 87. Accordingly, an audio signal obtained by performing sound quality control processing adaptively through gain adjustments on each of the original signal, speech signal, and music signal is generated before being supplied to the speakers 15 for reproduction via an output terminal 88.

Each of the scores output from the speech characteristic score calculation module 82 and the music characteristic score calculation module 83 is supplied to a mixing control module 89. The mixing control module 89 outputs a difference Ssub between the input speech characteristic score Ss and music characteristic score Sm to the speech enhancement processing module 79 and the music enhancement processing module 80. In the speech enhancement processing module 79 and the music enhancement processing module 8C, the degree of sound quality control processing on the speech signal and music signal is set based on the score difference Ssub.

In the mixing control module 89, gains Go, Gs, and Gm to be provided to the variable gain amplifiers 84, 85, and 86 respectively are set based on the difference Ssub between the input speech characteristic score Ss and music characteristic score Sm. Accordingly, optimal sound quality control processing through gain adjustments will be performed on an original signal, speech signal, and music signal output from the original signal delay compensation module 78, the speech enhancement processing module 79, and the music enhancement processing module 80 respectively.

Figure 4:
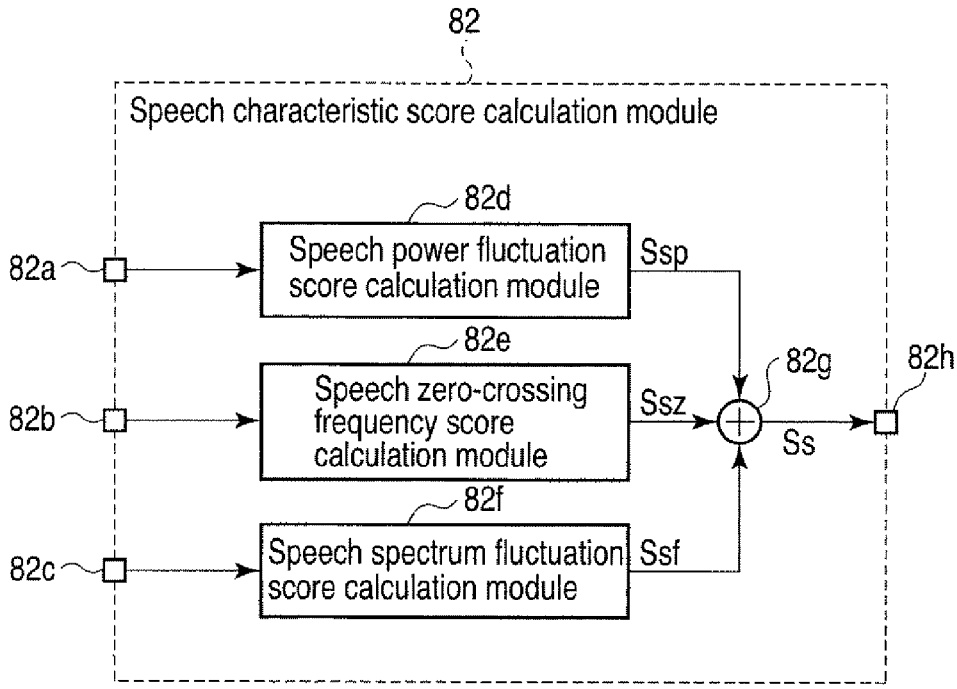
FIG. 4 is a block diagram shown to illustrate a speech characteristics score calculation module provided to the sound quality control processing module in the embodiment.

FIG. 4 shows the speech characteristic score calculation module 82. In the speech characteristic score calculation module 82, statistics of the power fluctuations, zero-crossing frequency, and spectrum fluctuations calculated by the characteristic parameter calculation module 81 are supplied to input terminals 82*a*, 82*b*, and 82*c* respectively as characteristic parameters.

Among these statistics, the statistic of the power fluctuations supplied to the input terminal 82*a* is supplied to a speech power fluctuation score calculation module 82*d*. Regarding the power fluctuations, generally an interval of utterance and that of non-utterance appear alternately in a speech and a difference in signal power becomes larger between sub-frames so that there is a tendency that variance of the power value among sub-frames becomes larger when viewed in frames. Thus, if the power fluctuation variance has a characteristic of being equal to or greater than a certain value, the speech power fluctuation score calculation module 82*d* determines that the signal has a high probability of being a speech signal and gives a speech characteristic score Ssp to the characteristic parameter (power fluctuations) and, if the power fluctuation variance is less than a certain value, the speech power fluctuation score calculation module 82*d* gives the score 0.

The statistic of the zero-crossing frequency supplied to the input terminal 82*b* is supplied to a speech zero-crossing frequency score calculation module 82*e*. Regarding the zero-crossing frequency, in addition to the difference between an interval of utterance and that of non-utterance described above, a speech signal has a high zero-crossing frequency for consonants and a low zero-crossing frequency for vowels so that there is a tendency that variance of the zero-crossing frequency among sub-frames becomes larger when viewed in frames. Thus, if the zero-crossing frequency has a characteristic of being equal to or greater than a certain value, the speech zero-crossing frequency score calculation module 82*e* determines that the signal has a high probability of being a speech signal and gives a speech characteristic score Ssz to the characteristic parameter (zero-crossing frequency) and, if the zero-crossing frequency is less than a certain value, the speech zero-crossing frequency score calculation module 82*e* gives the score 0.

Further, the statistic of the spectrum fluctuations supplied to the input terminal 82*c* is supplied to a speech spectrum fluctuations score calculation module 82*f*. Regarding the spectrum fluctuations, fluctuations in frequency characteristics are more violent in a speech signal than a tonal (articulation structural) signal like a music signal so that there is a tendency that variance of the spectrum fluctuations become larger when viewed in frames. Thus, if the spectrum fluctuations variance has a characteristic of being equal to or greater than a certain value the speech spectrum fluctuations score calculation module 82*f* determines that the signal has a high probability of being a speech signal and gives a speech characteristic score Ssf to the characteristic parameter (spectrum fluctuations) and, if the spectrum fluctuations variance is less than a certain value, the speech spectrum fluctuations score calculation module 82*f* gives the score 0.

Then, the speech characteristic score calculation module 82 adds each score set by the speech power fluctuation score calculation module 82*d*, the speech zero-crossing frequency score calculation module 82*e*, and the speech spectrum fluctuations score calculation module 82*f* in an adder 82*g* and outputs an added value (summation) thereof as the speech characteristic score Ss from an output terminal 82*h*.

Figure 5:
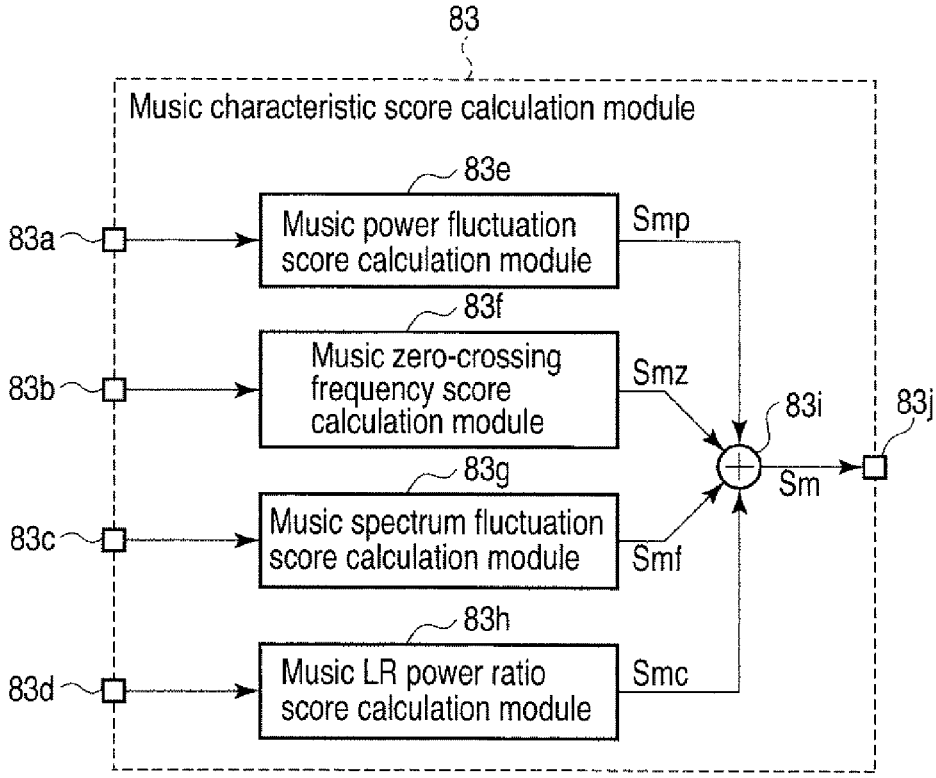
FIG. 5 is a block diagram shown to illustrate a music characteristics score calculation module provided to the sound quality control processing module in the embodiment.

FIG. 5 shows the music characteristic score calculation module 83. In the music characteristic score calculation module 83, statistics of the power fluctuations, zero-crossing frequency, spectrum fluctuations, and LR power ratio calculated by the characteristic parameter calculation module 81 are supplied to input terminals 83*a*, 83*b*, 83*c*, and 83*d* respectively as characteristic parameters.

Among these statistics, the statistic of the power fluctuations supplied to the input terminal 83*a* is supplied to a music power fluctuation score calculation module 83*e*, the statistic of the zero-crossing frequency supplied to the input terminal 83*b* is supplied to a music zero-crossing frequency score calculation module 83*f*, and the statistic of the spectrum fluctuations supplied to the input terminal 83*c* is supplied to a music spectrum fluctuations score calculation module 83*g*.

Since a music signal generally is tonal and has steady characteristics compared with a speech signal and thus, there is a tendency that statistics (variance) of the power fluctuations, zero-crossing frequency, and spectrum fluctuations become smaller when viewed in frames Thus, if each of input characteristic parameters (statistics of the power fluctuations, zero-crossing frequency, and spectrum fluctuations) has a characteristic of being equal to or less than a certain threshold, the music power fluctuation score calculation module 83*e*, the music zero-crossing frequency score calculation module 83*f*, and the music spectrum fluctuations score calculation module 83*g* determine that the signal has a high probability of being a music signal and give music characteristic scores Smp, Smz, and Smf to the characteristic parameters thereof respectively, and if each of the input characteristic parameters is more than a certain value, each of the modules 83*e*, 83*f*, and 83*g* gives the score 0.

The statistic of the LW power ratio supplied to the input terminal 83*d* is supplied to a music LR power ratio score calculation module 83*h*. Regarding the LR power ratio, music signals of music instrument playing excluding vocals are localized frequently outside the center so that there is a tendency that the power ratio between left and right channels becomes larger. Thus, if the LR power ratio has a characteristic of being equal to or greater than a certain value, the music LR power ratio score calculation module 83*h* determines that the signal has a high probability of being a music signal and gives a music characteristic score Smc to the characteristic parameter (LR power ratio) and, if the LR power ratio is less than a certain value, the music LW power ratio score calculation module 83*h* gives the score 0.

Then, the music characteristic score calculation module 83 adds each score set by the music power fluctuation score calculation module 83*e*, the music zero-crossing frequency score calculation module 83*f*, the music spectrum fluctuations score calculation module 83*g*, and the music LR power ratio score calculation module 83*h* in an adder 83*i* and outputs an added value (summation; thereof as the music characteristic score Sm from an output terminal 83*j*.

By scoring each of a speech signal and a music signal contained in an audio signal for each characteristic parameter, as describe above, the ratio of the speech signal and music signal can quantitatively evaluated. Then, the scores Ss and Sm obtained by the speech characteristic score calculation module 82 and the music characteristic score calculation module 83 respectively are supplied to the mixing control module 89.

Here, a technique used by the mixing control module 89 to set the gains Go, Gsr and Gm provided to the variable gain amplifiers 84, 85, and 86 based on the input speech characteristic score Ss and the music characteristic score Sm will be described. That is, to set the gains Go, Gs, and Gm from the speech characteristic score Ss and the music characteristic score Sm, the mixing control module 89 first calculates the difference Ssub (=Ss−Sm) between the speech characteristic score Ss and music characteristic score Sm. The positive difference Ssub means that the speech signal is stronger and the negative difference Ssub means that the music signal is stronger.

Figure 6:
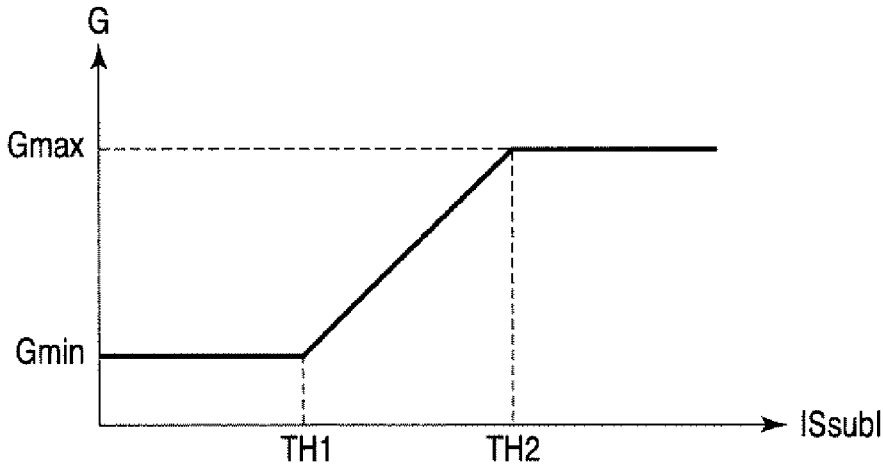
FIG. 6 is a characteristics diagram shown to illustrate a setting technique of gain given to each variable gain amplifier provided to the sound quality control processing module in the embodiment.

FIG. 6 shows a relationship between the score difference Ssub and gain G (Gs or Gm). That is, if the absolute value |Ssub| of the score difference Ssub is smaller than a preset threshold value TH1, that is, |Ssub|<TH1, the gain G is set to Gmin. If the absolute value |sub| of the score difference Ssub is equal to or greater than a preset threshold value TH2, that is, |Ssub|>TH2, the gain G is set to Gmax.

Further, if the absolute value |Ssub| of the score difference Ssub is equal to or greater than the threshold value TH1 and is smaller than the threshold value TH2, that is, TH1≦|Ssub|≦TH2, the gain G becomes G=Gmin+(Gmax−Gmin)/(TH2−TH1)×(|Ssub|−TH1).

The gain G is saturated when the absolute value |Ssub| of the score difference Ssub is smaller than the threshold value TH1 or equal to or greater than the threshold value TH2 because drifting of the gain G in a state in which the determination of the speech or music is steady is thereby suppressed.

Then, when the score difference Ssub is positive, the gain Gm to be provided to the variable gain amplifier 86 amplifying a music signal is controlled to 0 and the gain Gs to be provided to the variable gain amplifier 85 amplifying a speech signal is determined from characteristics shown in FIG. 6 in accordance with the score difference Ssub. When the score difference Ssub is negative, the gain Gs to be provided to the variable gain amplifier 85 amplifying a speech signal is controlled to 0 and the gain Gm to be provided to the variable gain amplifier 86 amplifying a music signal is determined from characteristics shown in FIG. 6 in accordance with the score difference Ssub.

The gain Go to be provided to the variable gain amplifier 84 amplifying an input audio signal (original signal) is set like Go=1.0−G to adjust signal power after mixing by the adder 87 based on the other gain G (Gs or Gm). Here, if the gain G (Gs or Gm) is 0, operations of the variable gain amplifiers 85 and 86 may be stopped.

A signal after adding signals obtained by multiplying the original signal, speech signal, and music signal by the gains Go, Gs, and Gm, obtained as described above, respectively is defined as an audio signal after sound quality control processing. While the score difference Ssub is used to calculate the gains Go, Gs, and Gm in the above description, gain control can similarly be exercised by using the score ratio or logarithmic values thereof.

Figure 7:
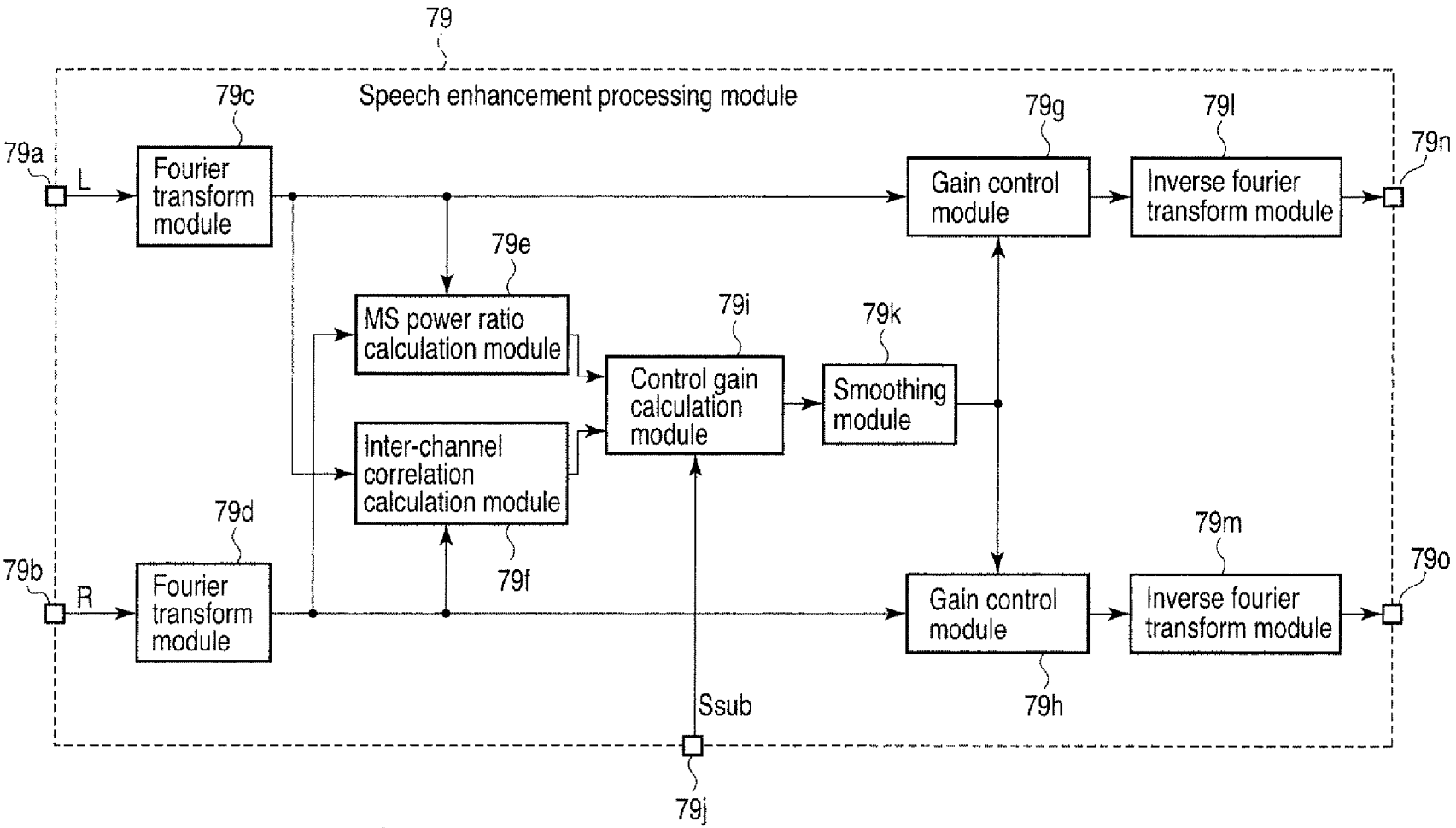
FIG. 7 is a block diagram shown to illustrate a speech enhancement processing module provided to the sound quality control processing module in the embodiment.

FIG. 7 shows the speech enhancement processing module 79. The speech enhancement processing module 79 functions, as described above, to emphasize speech signals localized in the center. That is, audio signals of left (L) and right (R) channels supplied to input terminals 79*a* and 79*b* are supplied to Fourier transform modules 79*c* and 79*d* respectively to be converted into frequency domain signals (spectra)

Then, an L channel audio signal component output from the Fourier transform module 79*c* is supplied to an MS power ratio calculation module 79*e*, an inter-channel correlation calculation module 79*f*, and a gain control module 79*g*. Also, an R channel audio signal component output from the Fourier transform module 79*d* is supplied to the MS power ratio calculation module 79*e*, the inter-channel correlation calculation module 79*f*, and a gain control module 79*h*.

Among these modules, the MS power ratio calculation module 79*e* calculates an MS power ratio (M/S) from a sum signal (N signal) and a difference signal (S signal) for each frequency bin of both channels. The M/S power ratio is calculated to extract spectrum components localized in the center, because the greater the M/S power ratio, the more signal components can be determined localized in the center.

The inter-channel correlation calculation module 79*f* calculates the correlation coefficient between spectra of both channels for each bandwidth on bark scale. Like the MS power ratio, the inter-channel correlation is calculated, because as the correlation coefficient increases (closer to 1), a spectrum signal component can be determined localized closer to the center.

Then, the MS power ratio calculated by the MS power ratio calculation module 79*e* and the inter-channel correlation coefficient calculated by the inter-channel correlation calculation module 79*f* are each supplied to a control gain calculation module 79*i*. The control gain calculation module 79*i* calculates a center localized score by addition after assigning weights to input parameters (the MS power ratio and inter-channel correlation coefficient). Then, based on the center localized score, the control gain for each frequency bin is determined to emphasize spectrum components localized in the center according to a relationship similar to that shown in FIG. 6 (however, thresholds are TH3 and TH4, as shown in FIG. 8).

That is, the control gain calculation module 79*i* increases the gain of a frequency component whose center localized score is high and decreases the gain of a frequency component whose center localized score is low. The control gain calculation module 79*i* can control an emphasis effect in accordance with the characteristic score as an alternative of gain control in the variable gain amplifiers 84, 85, and 86 by the mixing control module 89 shown in FIG. 3 or as parallel processing.

Figure 8:
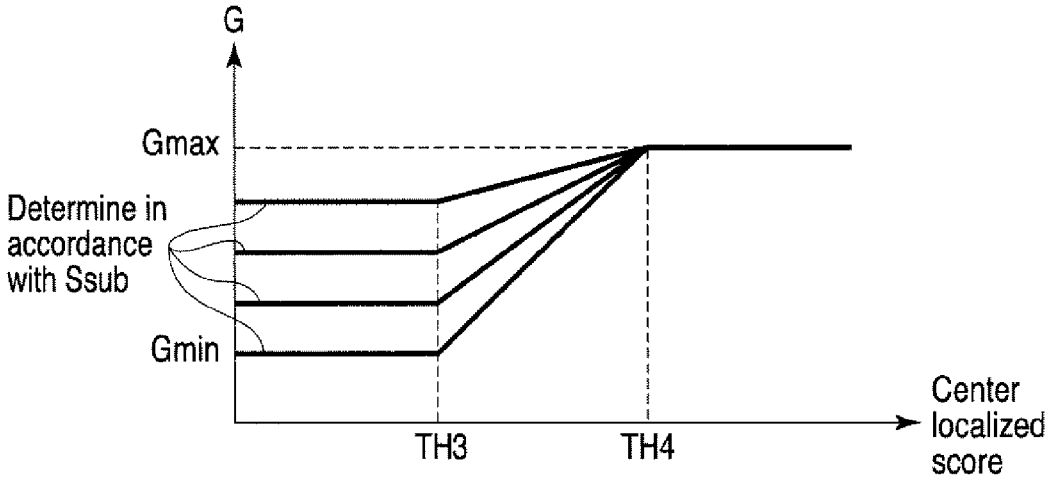
FIG. 8 is a characteristics diagram shown to illustrate a setting technique of control gain used by the speech enhancement processing module in the embodiment.

More specifically, the control gain calculation module 79*i* can determine that a signal is a speech signal when the score difference Ssub supplied via an input terminal 79*j* is positive and so, an emphasis effect is made available more easily, as shown in FIG. 8, by controlling enhancement characteristics so as to increase the lower limit of control gain (or decrease the threshold TH3) based on the score difference Ssub.

Then, the control gain calculated by the control gain calculation module 79*i* is supplied to a smoothing module 79*k*. The smoothing module 79*k* smoothes control gains to avoid an unusual sound generated when control gains calculated by the control gain calculation module 79*i* are significantly different in adjacent frequency bins and then supplies the smoothed control gains to the gain control modules 79*g* and 79*h*.

These gain control modules 79*g* and 79*h* perform emphasis processing on input L and R channel audio signal components by multiplication of the control gain for each frequency bin respectively. Then, the input L and R channel audio signal components corrected by the gain control modules 79*g* and 79*h* are supplied to inverse Fourier transform modules 79*l* and 79*m* to be brought back from frequency domain signals to time domain signals before being output to the variable gain amplifier 85 via output terminals 79*n* and 79*o* respectively.

While emphasizing the center of 2-channel audio signals is described in FIG. 7, similar processing can be performed for a multi-channel audio signal by emphasizing the center channel.

Figure 9:
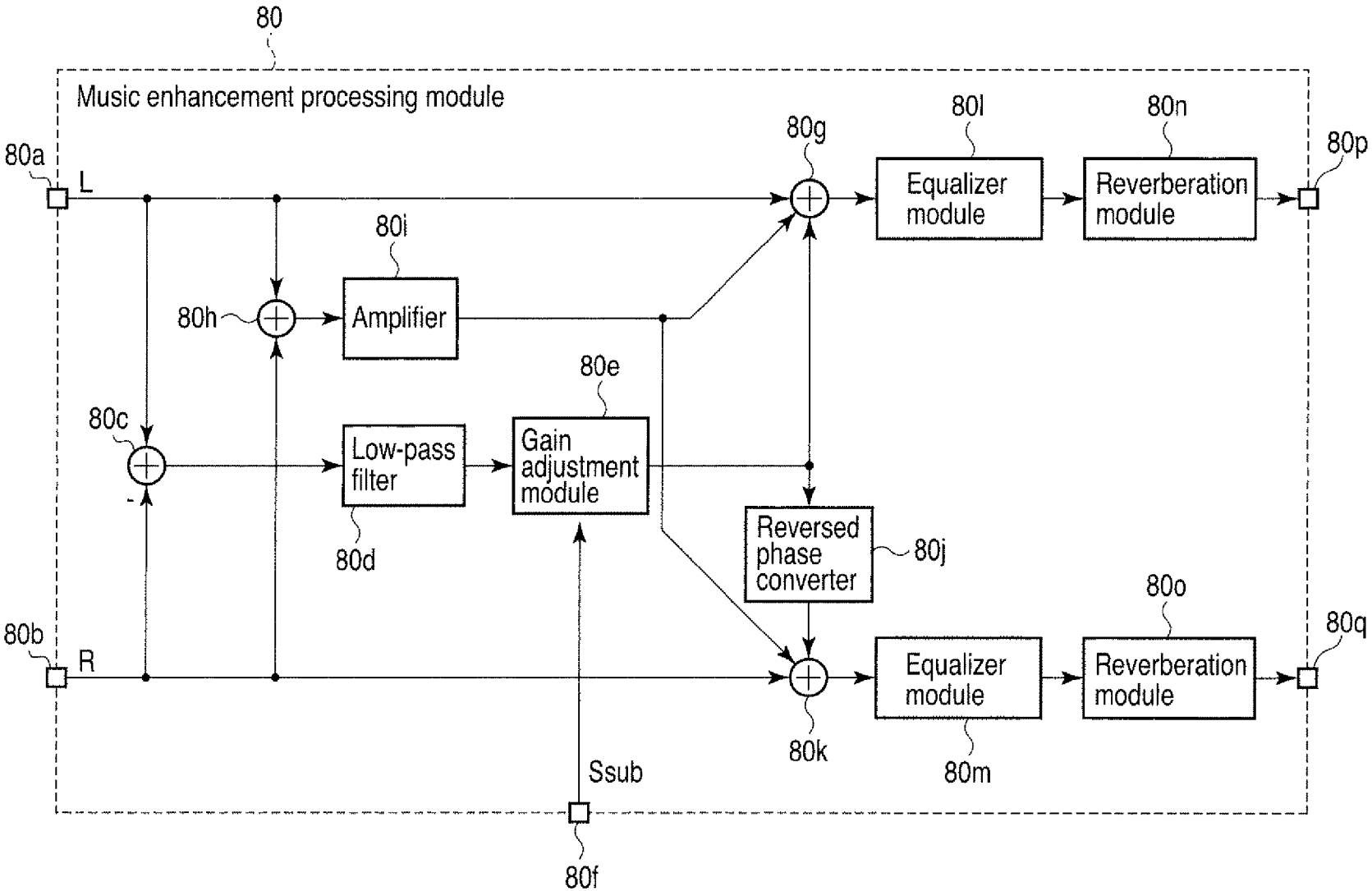
FIG. 9 is a block diagram shown to illustrate a music enhancement processing module provided to the sound quality control processing module in the embodiment.

FIG. 9 shows the music enhancement processing module 80. The music enhancement processing module 80 functions to realize a sound field with a sense of spreading by performing, as described above, wide-stereo processing and reverberation processing on a music signal. That is, left (L) and right (R) channel audio signals supplied to input terminals 80*a* and 80*b* are supplied to a subtractor 80*c* to determine a difference therebetween to emphasize a sense of stereo (to create a sense of wideness).

Then, the difference is passed through a low-pass filter 80*d* whose cutoff frequency is about 1 kHz to further improve audibility characteristics before being supplied to a gain adjustment module 80*e*, where gain adjustments based on the score difference Ssub supplied via an input terminal 80*f* are made. The signal after gain adjustments is added to an L channel audio signal supplied to the input terminal 80*a* and a signal obtained by adding L and R channel audio signals supplied to the input terminals 80*a* and 80*b* by an adder 80*h* and amplified by an amplifier 80*i* by an adder 80*g*.

The signal gain-adjusted by the gain adjustment module 80*e* is reversed in phase by a reversed phase converter 80*j* and then added to an R channel audio signal supplied to the input terminal 80*b* and an output signal of the amplifier 80*i* by an adder 80*k*. By an L channel audio signal and an R channel audio signal being reversed in opposite phase before being added, as described above, a difference between L and R can be emphasized.

Here, in the gain adjustment module 80*e*, an emphasis effect can be controlled in accordance with the characteristic score as an alternative of gain control in the variable gain amplifiers 84, 85, and 86 by the mixing control module 89 shown in FIG. 3 or as parallel processing. More specifically, the gain adjustment module 80*e* can determine that a signal is a music signal when the score difference Ssub is negative and so, a emphasis effect is made available more easily by controlling the gain of a differential signal obtained from the subtractor 80*c* in accordance with |Ssub| (that is, like characteristics shown in FIG. 6, the gain is increased with increasing |Ssub|).

In order to compensate for lowering of center components due to differential signal emphasis, a signal obtained after gain adjustments (attenuated) by the amplifier 80*i* of a sum signal of L and R channel audio signals added by the adder 80*h* is added to each by the adders 80*g* and 80*k*.

Then, outputs of the adders 80*g* and 80*k* are supplied to equalizer modules 80*l* and 80*m*. These equalizer modules 80*l* and 80*m* emphasizes a high frequency band from the viewpoint of improving aural characteristics of a stereo signal and compensating for a relative drop of the high frequency band due to the difference signal passed through the low-pass filter 80*d* and also overall gain adjustments are made to suppress a sense of discomfort due to power fluctuations before and after enhancement.

Then, outputs of the equalizer modules 80*l* and 80*m* are supplied to reverberation modules 80*n* and 80*o* respectively. These reverberation modules 80*n* and 80*o* performs convolution of impulse responses having delay characteristics imitating reverberation in a reproduction environment (such as a room) to generate a corrected sound providing a sound field effect of spreading suitable for listening to music. Then, outputs of the reverberation modules 80*n* and 80*o* are output to the variable gain amplifier 86 via output terminals 80*p* and 80*q* respectively.

Figure 10:
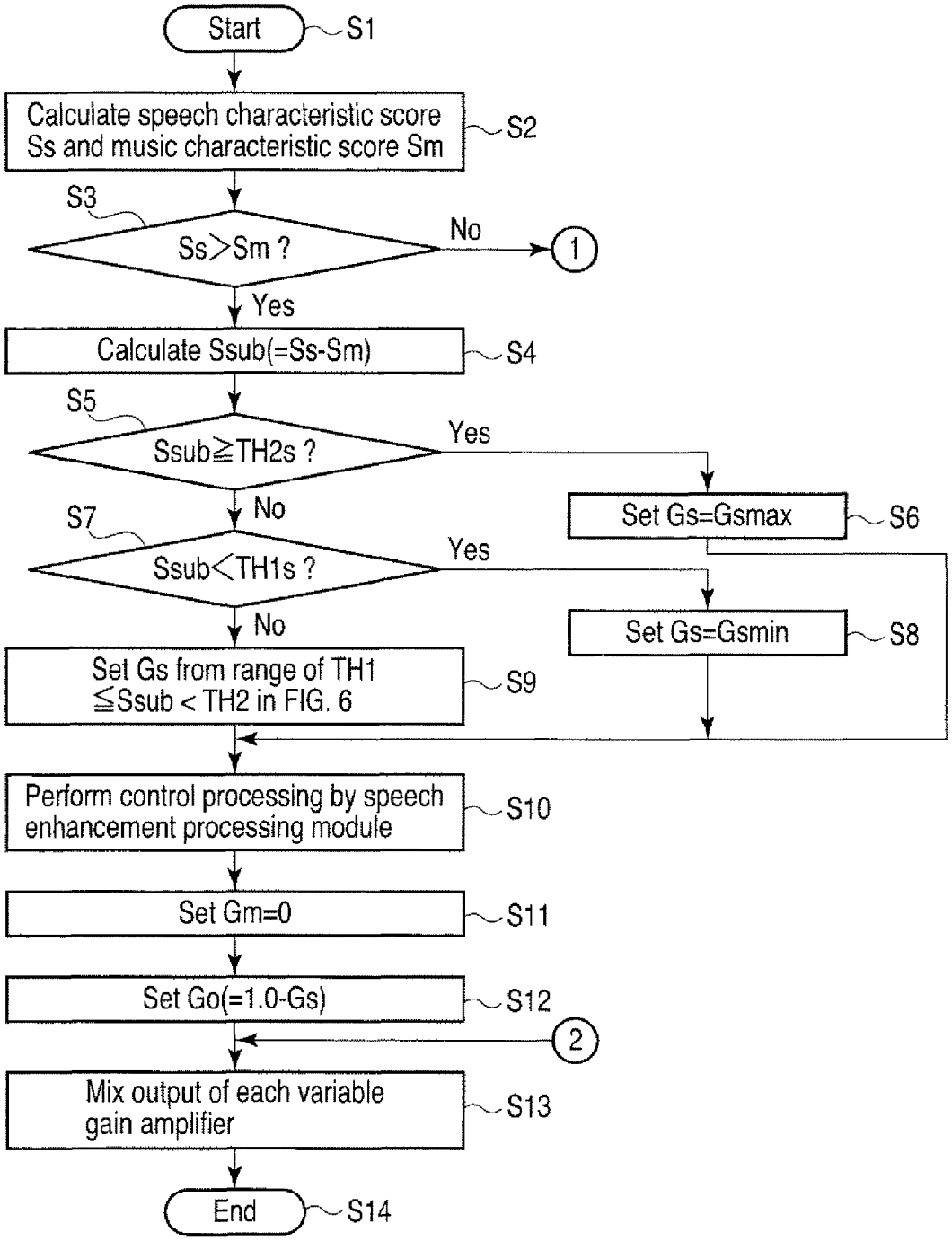
FIG. 10 is a flow chart shown to illustrate a portion of operation performed by the sound quality control processing module in the embodiment.
Figure 11:
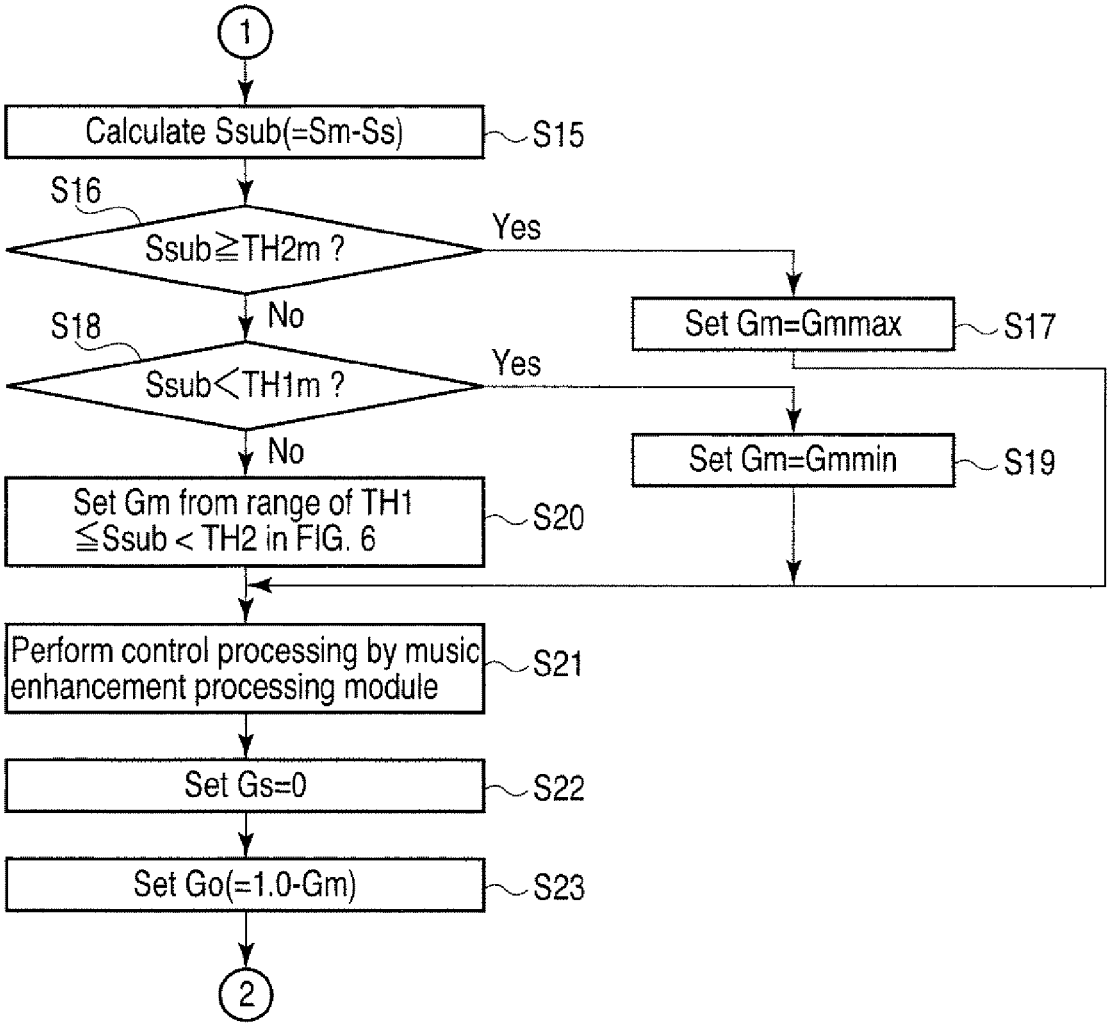
FIG. 11 is a flow chart shown to illustrate the remainder of operation performed by the sound quality control processing module in the embodiment.

FIGS. 10 and 11 together show a flow chart summarizing a series of sound quality control operations performed by the sound quality control processing module 76. That is, when processing is started (step S1), the sound quality control processing module 76 calculates the speech characteristic score Ss and the music characteristic score Sm at step S2 and determines whether or not the speech characteristic score Ss is greater than the music characteristic score Sm, that is, Ss>Sm at step S3.

Then, if it is determined that Ss>Sm holds (YES), the sound quality control processing module 76 calculates the score difference Ssub (=Ss−Sm) by subtracting the music characteristic score Sm from the speech characteristic score Ss at step S4. Subsequently, the sound quality control processing module 76 determines whether or not the score difference Ssub is equal to or greater than a preset upper limit threshold TH2*s* for speech signal, that is, Ssub≧TH2*s* at step S5. Then, if it is determined that Ssub≧TH2*s* holds (YES), the sound quality control processing module 76 sets the enhancement output gain of speech signal (gain to be provided to the variable gain amplifier 85) Gs to Gsmax at step S6.

If it is determined that Ssub≧TH2*s* does not hold (NO) at step S5, the sound quality control processing module 76 determines whether or not the score difference Ssub is smaller than a preset lower limit threshold TH1s for speech signal, that is, Ssub<TH1*s* at step S7. Then, if it is determined that Ssub<TH1*s* holds (YES), the sound quality control processing module 76 sets the enhancement output gain of speech signal (gain to be provided to the variable gain amplifier 85) Gs to Gsmin at step S8.

Further, if it is determined that Ssub<TH1*s* does not hold (NO) at step S7, the sound quality control processing module 76 sets the enhancement output gain of speech signal (gain to be provided to the variable gain amplifier 85) Gs based on characteristics shown in FIG. 6 in the range of TH1≦Ssub<TH2 at step S9.

After the step S6, S8, or S9, the sound quality control processing module 76 performs sound quality control processing on a speech signal by the speech enhancement processing module 79 at step S10. Subsequently, the sound quality control processing module 76 sets the enhancement output gain for music signal (gain to be provided to the variable gain amplifier 86) Gm to 0 at step S11.

Moreover, the sound quality control processing module 76 calculates the enhancement output gain for original signal (gain to be provided to the variable gain amplifier 84) Go by 1.0−Gs at step S12. Subsequently, the sound quality control processing module 76 mixes outputs of the variable gain amplifiers 84 to 86 at step S13 before terminating processing (step S14).

If, on the other hand, it is determined that Ss>Sm does not hold (NO) at step S3, the sound quality control processing module 76 calculates the score difference Ssub (=Sm−Ss) by subtracting the speech characteristic score Ss from the music characteristic score Sm at step S15. Subsequently, the sound quality control processing module 76 determines whether or not the score difference Ssub is equal to or greater than a preset upper limit threshold TH2*m* for music signal, that is, Ssub≧TH2*m* at step S16. Then, if it is determined that Ssub≧TH2m holds (YES), the sound quality control processing module 76 sets the enhancement output gain of music signal (gain to be provided to the variable gain amplifier 86) Gm to Gmmax at step S17.

If it is determined that Ssub≧TH2*m* does not hold (NO) at step S16, the sound quality control processing module 76 determines whether or not the score difference Ssub is smaller than a preset lower limit threshold TH1*m* for music signal, that is, Ssub<TH1*m* at step S18. Then, if it is determined that Ssub<TH1*m* holds (YES), the sound quality control processing module 76 sets the enhancement output gain of speech signal (gain to be provided to the variable gain amplifier 86) Gm to Gmmin at step S19.

Further, if it is determined that Ssub<TH1*m* does not hold (NO) at step S18, the sound quality control processing module 76 sets the enhancement output gain of music signal (gain to be provided to the variable gain amplifier 86) Gm based on characteristics shown in FIG. 6 in the range of TH1≦Ssub<TH2 at step S20.

After the step S17, S19, or S20, the sound quality control processing module 76 performs sound quality control processing on a music signal by the music enhancement processing module 80 at step S21. Subsequently, the sound quality control processing module 76 sets the enhancement output gain for speech signal (gain to be provided to the variable gain amplifier 85) Gs to 0 at step S22.

Moreover, the sound quality control processing module 76 calculates the output gain for original signal (gain to be provided to the variable gain amplifier 84) Go by 1.0−Gm at step S23 before proceeding to processing at step S13.

In the present embodiment, as described above, whether an input audio signal is closer to speech signal characteristics or music signal characteristics is determined based on a score and by controlling a enhancement method and enhancement degree in accordance with the score, optimal sound quality controls can be made accurately with low delay.

In the above embodiment, sound quality control processing by the speech enhancement processing module 79 and the music enhancement processing module 80 and that by the variable gain amplifiers 84 to 86 are both performed based on the score difference Ssub, but sound quality control processing by the variable gain amplifiers 84 to 86 may be needed when necessary.

The various modules of the systems described herein can be implemented as software applications, hardware and/or software modules, or components on one or more computers, such as servers. While the various modules are illustrated separately, they may share some or all of the same underlying logic or code.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A sound quality control apparatus comprising:

a characteristic parameter calculator configured to calculate various kinds of characteristic parameters to determine a speech signal and a music signal from an input audio signal;

a speech characteristic score calculator configured to provide scores to, among various kinds of characteristic parameters calculated by the characteristic parameter calculator, characteristic parameters indicating a speech signal and to calculate a sum of provided scores as a speech characteristic score;

a music characteristic score calculator configured to provide scores to, among various kinds of characteristic parameters calculated by the characteristic parameter calculator, characteristic parameters indicating a music signal and to calculate a sum of provided scores as a music characteristic score; and a controller configured to determine closeness to a speech signal or a music signal of the input audio signal based on a score difference between the speech characteristic score calculated by the speech characteristic score calculator and the music characteristic score calculated by the music characteristic score calculator and to perform sound quality control processing for speech or music, the controller comprises a speech enhancement processor constructed so as to make controls to emphasize center localized components in accordance with the score difference with respect to the input audio signal when the input audio signal is determined closer to a speech signal based on the score difference between the speech characteristic score and the music characteristic score.

2. A sound quality control apparatus of claim 1, wherein the characteristic parameter calculator is configured to calculate various kinds of characteristic parameters including any one of power fluctuations, a zero-crossing frequency, spectrum fluctuations in a frequency domain, and a power ratio of left and right signals of stereo.

3. A sound quality control apparatus of claim 1, wherein the controller comprises a speech enhancement processor constructed so as to make controls to emphasize center localized components in accordance with the score difference with respect to the input audio signal when the input audio signal is determined closer to a speech signal based on the score difference between the speech characteristic score and the music characteristic score.

4. A sound quality control apparatus of claim 1, wherein the controller comprises a speech amplifier constructed so as to perform amplification processing with a gain in accordance with the score difference on an output signal of the speech enhancement processor when the input audio signal is determined closer to a speech signal based on the score difference between the speech characteristic score and the music characteristic score.

5. A sound quality control apparatus of claim 1, wherein the controller comprises a music enhancement processor constructed so as to make controls to generate a sound field of a sense of spreading in accordance with the score difference with respect to the input audio signal when the input audio signal is determined closer to a music signal based on the score difference between the speech characteristic score and the music characteristic score.

6. A sound quality control apparatus of claim 5, wherein the controller comprises a music amplifier constructed so as to perform amplification processing with a gain in accordance with the score difference on an output signal of the music enhancement processor when the input audio signal is determined closer to a music signal based on the score difference between the speech characteristic score and the music characteristic score.

7. A sound quality control method comprising:

calculating various kinds of characteristic parameters to determine a speech signal and a music signal by supplying an input audio signal to a characteristic parameter calculator;

providing scores to characteristic parameters indicating a speech signal by supplying various kinds of calculated characteristic parameters to the speech characteristic score calculator to calculate a sum of provided scores as a speech characteristic score;

providing scores to characteristic parameters indicating a music signal by supplying various kinds of calculated characteristic parameters to the music characteristic score calculator to calculate a sum of provided scores as a music characteristic score; and determining closeness to a speech signal or a music signal of the input audio signal by supplying a score difference between the speech characteristic score and the music characteristic score to a controller to perform sound quality control processing for speech or music; and emphasizing center localized components in accordance with the score difference with respect to the input audio signal when the input audio signal is determined closer to a speech signal based on the score difference between the speech characteristic score and the music characteristic score.

8. A sound quality control program stored in a memory of a computer and executed by a processor to perform operations comprising:

calculating various kinds of characteristic parameters by a characteristic parameter calculator to determine a speech signal and a music signal from an input audio signal;

providing scores to, among the various kinds of characteristic parameters calculated by the characteristic parameter calculator, characteristic parameters indicating a speech signal and to calculate a sum of provided scores as a speech characteristic score;

providing scores to, among the various kinds of characteristic parameters calculated by the characteristic parameter calculator, characteristic parameters indicating a music signal and to calculate a sum of provided scores as a music characteristic score;

determining closeness to a speech signal or a music signal of the input audio signal based on a score difference between the speech characteristic score and the music characteristic score and to perform sound quality control processing for speech or music; and emphasizing center localized components in accordance with the score difference with respect to the input audio signal when the input audio signal is determined closer to a speech signal based on the score difference between the speech characteristic score and the music characteristic score.

* * * * *